US005743397A

United States Patent [19]

Traver

[11] Patent Number: 5,743,397

[45] Date of Patent: Apr. 28, 1998

[54] TOILET PAPER STORAGE RECEPTACLE

[76] Inventor: Vickie Traver, 710 5th Ave. SW #2, Albany, Oreg. 97321

[21] Appl. No.: 367,741

[22] Filed: Jan. 3, 1995

[51] Int. Cl.[6] ..... B65D 85/672

[52] U.S. Cl. ..... 206/391; 206/812; 220/23.8

[58] Field of Search ..... 220/23.8, 516, 220/DIG. 13; 206/391, 392, 393, 394, 430, 455, 812

[56] References Cited

U.S. PATENT DOCUMENTS

| | | | |
|---|---|---|---|
| D. 277,815 | 3/1985 | Veilleux . | |
| D. 306,104 | 2/1990 | Merdic . | |
| D. 307,086 | 4/1990 | Van Marcke et al. . | |
| D. 319,552 | 9/1991 | Christensen . | |
| D. 330,984 | 11/1992 | Evans . | |
| 2,534,290 | 12/1950 | Moskowitz . | |
| 2,718,303 | 9/1955 | Poglase | 206/394 |
| 2,892,540 | 6/1959 | Tupper | 220/23.8 X |
| 3,193,179 | 7/1965 | Bogren | 206/391 X |
| 3,245,626 | 4/1966 | Casteel . | |
| 3,275,133 | 9/1966 | Wood . | |
| 3,410,394 | 11/1968 | Jackson et al. | 206/393 |
| 3,670,938 | 6/1972 | Brocato | 220/23.8 X |
| 3,685,717 | 8/1972 | Seiferth et al. | 220/23.8 X |
| 4,177,958 | 12/1979 | Poole . | |
| 4,368,840 | 1/1983 | Pardo | 220/23.8 X |
| 4,369,929 | 1/1983 | Cayer . | |
| 4,607,809 | 8/1986 | Sineni et al. . | |
| 4,775,109 | 10/1988 | Tegg | 206/391 X |
| 5,263,602 | 11/1993 | Lathouris | 206/430 X |

*Primary Examiner*—Jacob K. Ackun

*Attorney, Agent, or Firm*—Nolte, Nolte and Hunter, P.C.

[57] ABSTRACT

The walls of a receptacle for storing a plurality of tangentially adjacent toilet paper rolls have a smaller cross sectional width between the rolls than the average diameter of the rolls.

2 Claims, 3 Drawing Sheets

TOILET PAPER STORAGE RECEPTACLE

BACKGROUND OF THE INVENTION

1. Field of the Invention

This invention pertains to special receptacles or packages, more specifically to a receptacle which provides unobtrusive, recognizable, storage of a plurality toilet paper rolls, and convenient one hand grip.

2. Description of the Prior Art

The art of toilet paper storage is a crowded one. It abounds with designs for storing two or more individual toilet paper rolls unwrapped or individually wrapped, axially or tangentially adjacent one another. The designs often include an apparatus to aid in removal of a roll, or one for withdrawal of paper from one of the rolls by uncoiling the paper from the roll.

For example, U.S. Pat. No. 3,275,133, patented Sep. 27, 1966 by Ruby A. Wood describes a vertical tube having a closed bottom, which receives an insert containing axially stacked individual toilet paper rolls.

The insert comprises a circular, horizontal bottom plate upon which the lowermost roll rests. The bottom plate hangs from a pair of vertical side strips. The top ends of the side strips are attached to a circular, horizontal top plate. The diameter of the top plate is greater than the diameter of the vertical tube, so that the top of the tube supports the top plate when the insert is in the tube.

A knob on the top plate helps a user lift the insert from the tube in order to, by lateral movement of a roll, add or remove a roll to or from the top of the stack.

U.S. Pat. No. 4,177,958 patented Dec. 11, 1979 by Judith A. Poole, describes a first vertical tube, sealed and weighted at the bottom, a second vertical tube sealed at the top and having the same diameter as the first tube, and a circular plate having an annular flange which is the diameter of the tubes.

The bottom tube contains axially stacked individual toilet paper rolls. The circular plate rests over the top of the bottom tube, sealing the rolls in the bottom tube for storage. The top of the circular plate has a vertical central spindle upon which is stored a toilet paper roll. The first tube rests on the circular plate, thereby enclosing the roll on the spindle.

Paper may be drawn from the roll by way of a vertical slot which extends substantially the length of the second tube.

U.S. Pat. No. 4,199,078 patented Apr. 22, 1980 by Edward Ramirez, discloses four straight, vertical walls forming a rectangular box that is open at the top and bottom. It is designed to be attached to a wall.

Individual rolls of toilet paper, vertically stacked side by side, their axis parallel to one another, fill the box. The bottom opening of the box has opposed, downward and inward bending tabs which together support the stack of rolls, and which are sufficiently flexible to permit withdrawal of a full or new roll of toilet paper by way of the bottom opening by expanding the tabs outward.

U.S. Pat. No. 4,314,679, patented Feb. 9, 1982 by Dennis J. Paul, et al., discloses four straight, vertical walls forming a rectangular box that is open at the top and bottom.

Individual rolls of toilet paper, vertically stacked side by side, their axis parallel to one another, fill the box. The bottom opening of the box has a lateral wall which supports the lowermost roll and which forms a lateral opening with the walls at the bottom of the box for withdrawing paper from the roll. An inward depending flange within the box just above the roll supports the bottom of the stack of remaining rolls. When the lowermost roll is used up, an operator brings a stacked roll down to replace it by extending a finger through a vertical slot in one wall of the box, engaging the roll resting on the second flange by the axial opening in the roll, and pulling it down past the flange. The top of the box has an inwardly angled flange which allows a roll to be inserted into the box but makes it difficult to withdraw the roll by way of the top of the box.

U.S. Pat. No. 5,040,679 patented Aug. 20, 1991 by Mary E. Rehmann, discloses a design which conceals the toilet paper rolls under the outward appearance of a doll. The toilet paper rolls are mounted one above the other on the handle of a toilet plunger. The body of a doll wearing a skirt fits over the handle with the skirt covering the toilet paper rolls and the suction cup of the plunger.

In the prior art, rolls which are loaded in the above storage receptacles are usually purchased in bulk unwrapped, individually wrapped, or in multiple roll packages. They are loaded into the receptacles unwrapped, or in singly wrapped units, depending upon the receptacle design. The receptacles are attached to a wall or toilet tank, or are relatively bulky and awkward to handle.

SUMMARY OF THE INVENTION

It is one object of the present invention to provide a toilet paper storage receptacle that stores a plurality of toilet paper rolls.

It is another object of the present invention to provide a toilet paper storage receptacle that stores multiple roll toilet paper packages just as they them come from the supplier.

It is another object of the present invention that the receptacle is easy to load with the toilet paper without having to separate each of the multiple rolls from the pack.

It is another object that the receptacle is easy to grip directly, without a handle.

It is another object that the receptacle, storing a plurality of side by side stacked rolls is, without a handle, as easy and natural to grasp as a multiple roll consumer package of toilet paper.

It is another object that the receptacle suggests but does not reveal its contents.

A receptacle for storing a multiple roll package of a plurality of toilet paper rolls which have an average diameter, includes first and second vertical tubular containers at the respective first and second ends of the receptacle.

The first container includes a first wall extending from the front to the back of the receptacle, generally C shaped in cross section, and attached to a bottom wall of the receptacle.

The second container includes a second wall extending from the front to the back of the receptacle, generally C shaped in cross section, and attached to the bottom wall of the receptacle.

The first and second containers have approximately the same diameter which is in close approximation to the average diameter of the rolls and which is sufficient for close fit, removable storage of the rolls in the containers.

A first vertical connector wall at the front of the receptacle between the first and second containers is attached to the bottom wall.

A second vertical connector wall at the back of the receptacle between the first and second containers and opposite the first vertical connector wall is attached to the bottom wall.

The cross sectional width between the first and second connector walls is smaller than the average diameter of the toilet paper rolls.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 2:
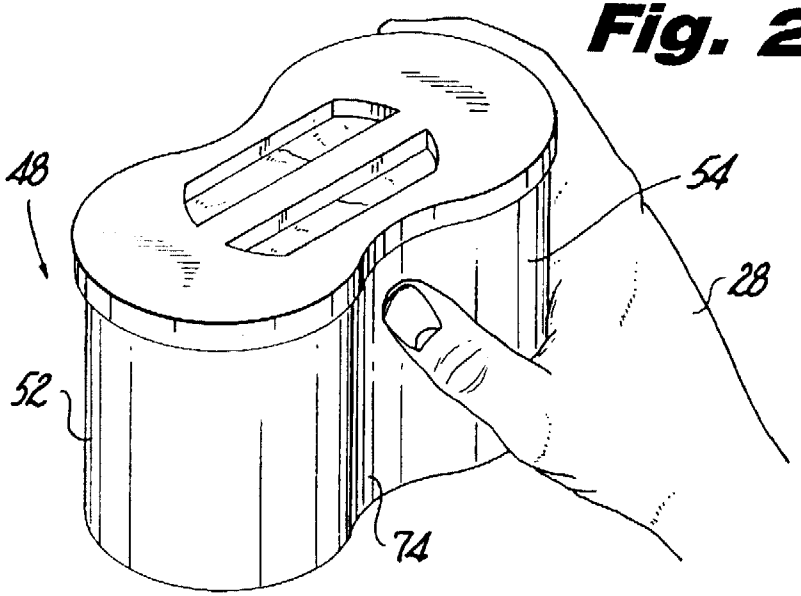
FIG. 2 is a perspective view of a present invention receptacle storing a double roll, multiple roll consumer package of toilet paper, grasped in a user's hand, with the cover of the receptacle in place on the receptacle.
Figure 4:
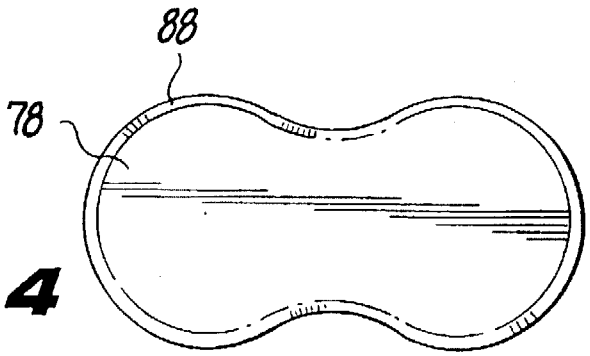
FIG. 4 is a bottom plan view of the receptacle of FIG. 2.
Figure 1:
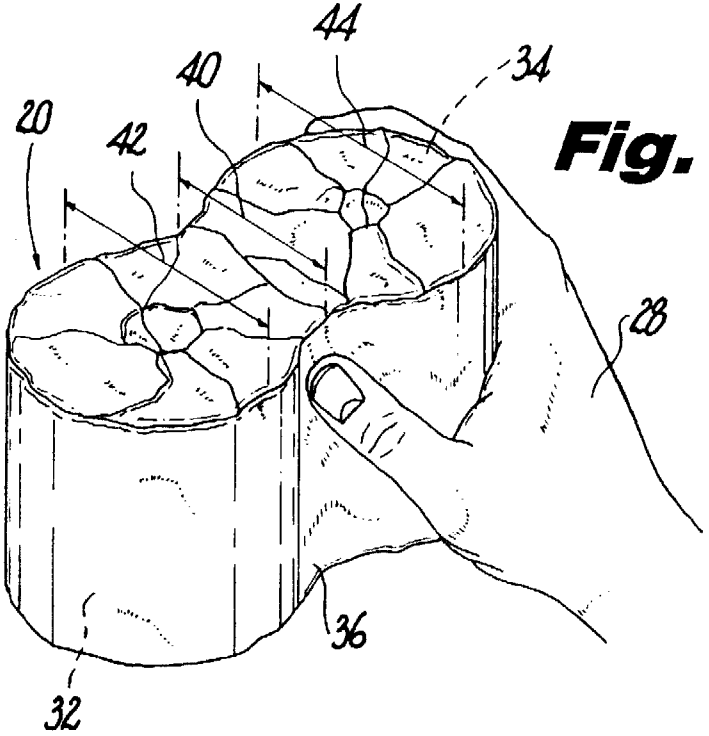
FIG. 1 is a perspective view of a double roll, multiple roll consumer package of toilet paper, grasped in a user's hand.
Figure 3:
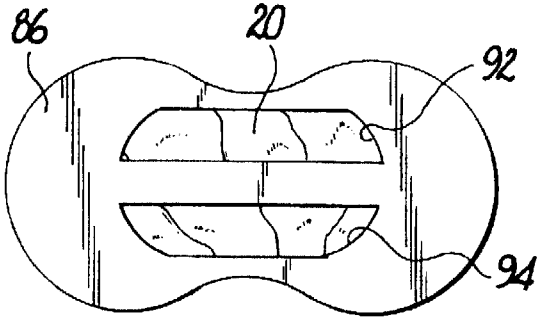
FIG. 3 is a top plan view of the receptacle of FIG. 2.
Figure 8:
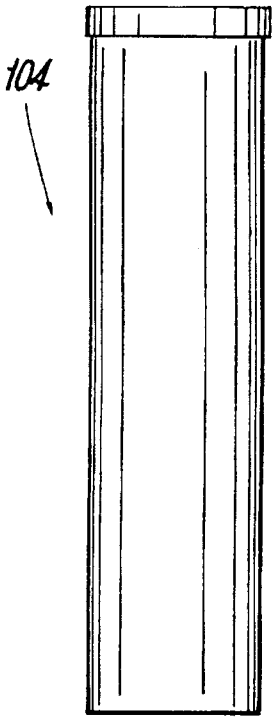
FIG. 8 is a side view of the receptacle of FIG. 7.
Figure 7:
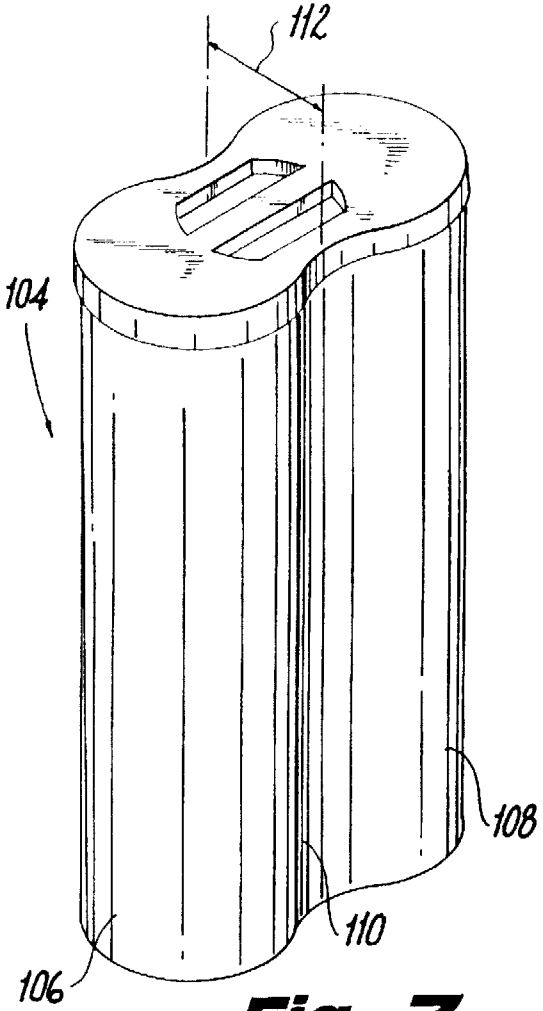
FIG. 7 is a perspective view of a present invention receptacle.
Figure 5:
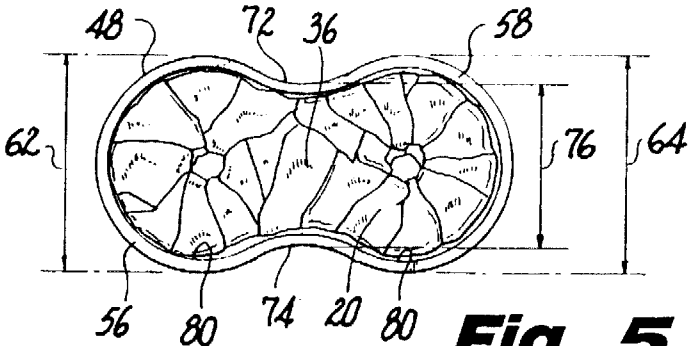
FIG. 5 is a top plan view of the receptacle of FIG. 2 with the cover removed, showing the double roll, multiple roll consumer package of toilet paper.
Figure 6:
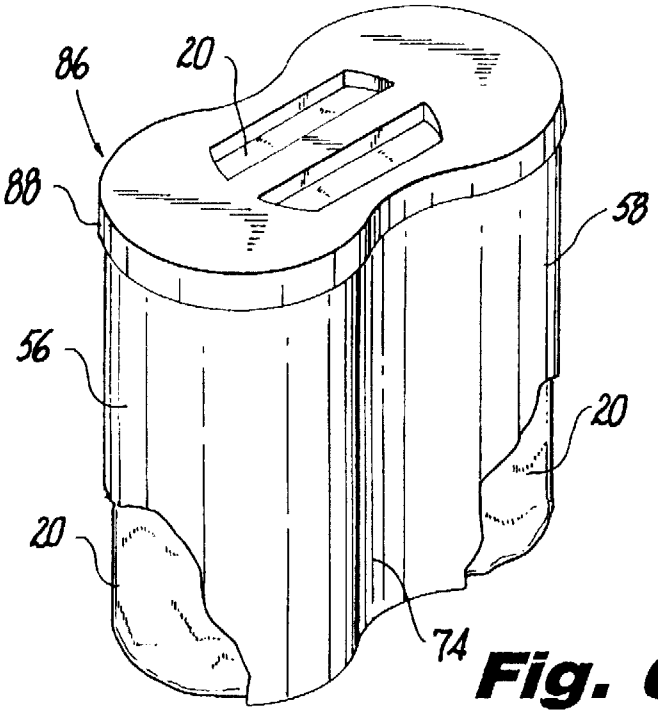
FIG. 6 is a perspective view of the receptacle of FIG. 2, with a portion of the outer wall of the receptacle removed to show the package within.

Before explaining the invention in detail, it is to be understood that the invention is not limited in its application to the detail of construction and arrangement of parts illustrated in the drawings, since the invention is capable of other embodiments and of being practiced or carried out in various ways. It is also to be understood that the phraseology or terminology employed is for the purpose of description only and not of limitation.

Referring to FIGS. 1–6 of the drawings, double roll, multiple roll consumer package of toilet paper 20 is conveniently grasped in user hand 28 by wrapping the hand around one of the two rolls 32 and 34 that are within single wrapper 36. Convenience in grasping is provided by the reduced cross sectional width 40 between rolls 32 and 34 compared to diameters 42 and 44 of the rolls, whereby the fingers and thumb of the user can be brought closer together around roll 34 than if the package had straight side walls bridging the two rolls and being tangent to each roll.

This convenience in grasping is also provided by receptacle 48 for package 20. The receptacle has two parallel tubular containers 52 and 54, comprising walls 56 and 58 which are generally straight along their length, generally C shaped in cross section, are approximately equal in diameters 62 and 64 to one another, and for example in FIGS. 4–6, include a pair of connecting walls 72 and 74 between them which extend from bottom wall 78 to the tops of walls 56 and 58, separating and spacing them and having a cross sectional width 76 that is smaller than the diameter of the tubular containers. The receptacle is conveniently grasped by wrapping hand 28 around one of the two end containers, whereby the fingers and thumb of the user can be brought closer together around the receptacle, making use of the smaller cross sectional width of connecting walls 72 and 74 than if the receptacle had straight side walls.

Diameters 62, 64, and width 76 are in close approximation to the average of diameters 42, 44, and to width 40 respectively of the double roll, multiple roll consumer package of toilet paper 20 contained within receptacle 48.

Preferably, package 20 fits closely in receptacle 48, but with sufficient looseness in fit for the user to grip roll 20 for removal from receptacle 48 without injurious scraping of the backs of the user's fingers on the edge of opening 80 of the receptacle.

Each multiple roll package of toilet paper varies slightly in dimension from another due to flexibility and compressibility. Receptacle 48 is designed so that the walls of the tubular containers and the connecting walls follow in cross section a curvilinear path that is generally defined by, but not identical to, the cross sectional curvilinear path of wrapper 36 of the multiple roll package 20 of toilet paper contained within the receptacle.

This provides the convenience in grasping of a multiple roll package of toilet paper in the receptacle for the package which does not reveal the package but suggests the contents.

Bottom wall 78 of receptacle 48 preferably provides a water tight bottom seal with the container walls and connecting walls. Cover 86 fits over opening 80, and is held in place by various frictional contact areas between downward depending wall 88 and walls 56, 58, 72 and 74 as the top of walls 56, 58, 72, and 74 have the cross sectional shape of their lower portions or sides. Slots 92 and 94 provide finger grips for holding the cover.

The receptacle of the present invention provides improved grasping convenience over multiple roll packaging of more than two rolls, and further to receptacle contents of more than one multiple roll package. This is because the receptacle is preferably made stiffer than the wrapper of the multiple roll package. Thus receptacle contents of multiple roll packages of two, three or more rolls; and two, three, or more multiple roll packages, can be held by one hand by an end container of the present invention.

Referring to FIGS. 7–10, receptacle 104 is designed to store four rolls of toilet paper in two multiple roll packages, each package having two rolls of tangentally adjacent toilet paper, or in a single package of two pairs of tangentally adjacent rolls, one pair stacked above the other. It would be difficult to hold all four rolls with stability, with one hand by gripping just one of the rolls. This is easily accomplished, however, by gripping tubular end container 106 or tubular end container 108 and connector wall 110 over the reduced cross sectional width 112 of the receptacle at wall 110.

Figure 9:
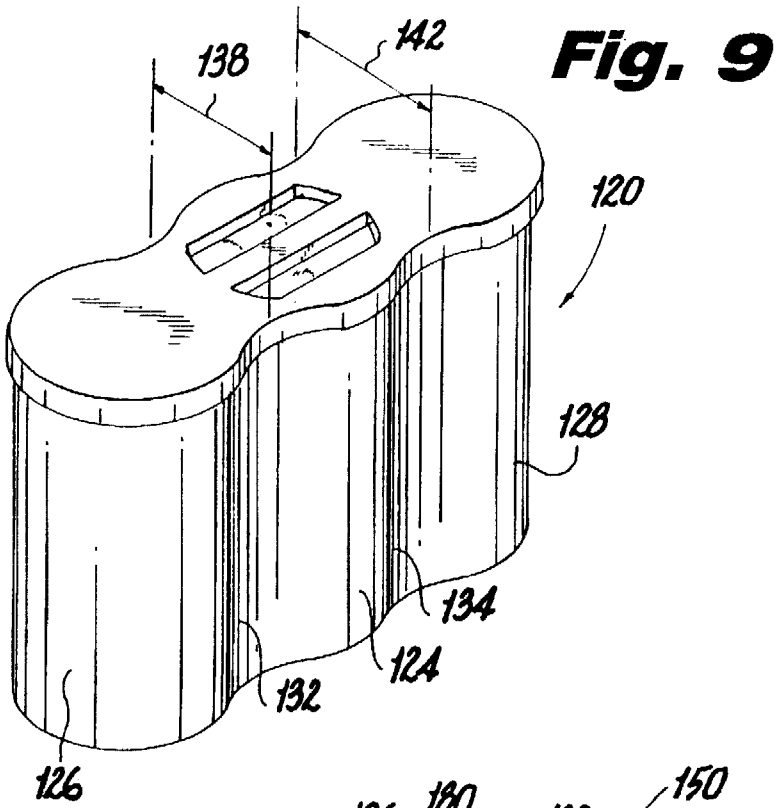
FIG. 9 is a perspective view of a present invention receptacle.
Figure 11:
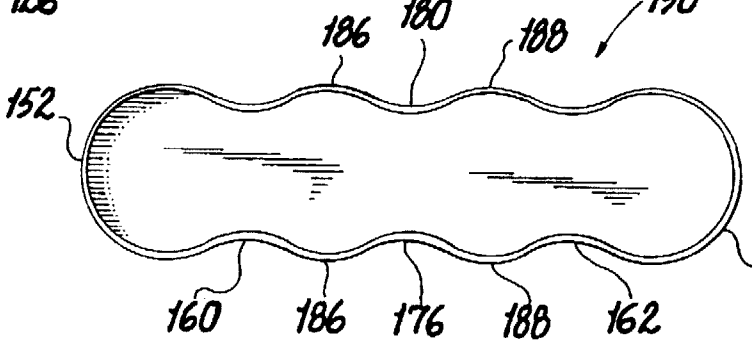
FIG. 11 is a top view of the receptacle of FIG. 10, with cover removed.

Receptacle 120 in FIG. 9 is designed with triple tubular containers 124, 126, and 128 to store one multiple roll package having three rolls of toilet paper. Holding the three rolls is easily accomplished by gripping end container 126 or 128 and adjacent respective connector walls 132 or 134 which comprise reduced cross sectional widths 138 and 142 of the receptacle.

Figure 10:
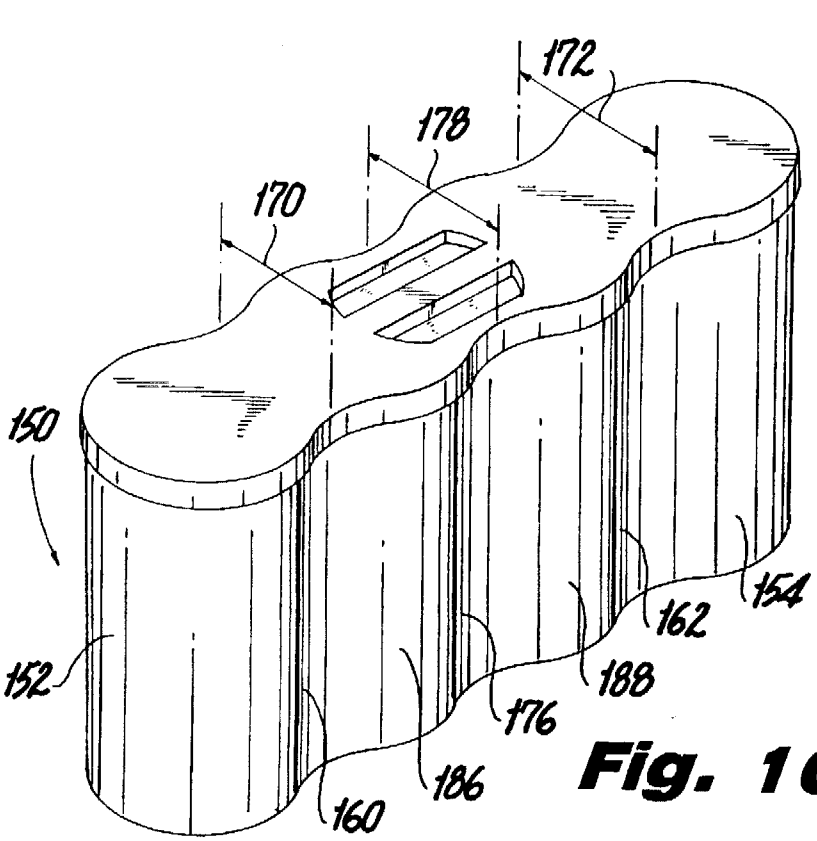
FIG. 10 is a perspective view of a present invention receptacle.

Receptacle 150 in FIG. 10 is designed to store one multiple roll package having four rolls of toilet paper. Holding the four rolls is easily accomplished by gripping tubular end container 152 or 154 and adjacent respective connector walls 160 or 162 which are over reduced cross sectional widths 170 and 172 of the receptacle. The four rolls can also be held by gripping connector wall 176 and the complimentary connector wall 180 on the other side of the receptacle which form reduced cross sectional width 178 that is adjacent to tubular containers 186 and 188 of receptacle 150.

Although the invention has been described in terms of specific preferred embodiments, it will be obvious to one skilled in the art that various modifications and substitutions are contemplated by the invention disclosed herein and that all such modifications and substitutions are included within the scope of the invention as defined in the appended claims.

What is claimed is:

1. A receptacle in combination with a multiple roll package of a plurality of tangentially adjacent toilet paper rolls, said rolls having an average diameter, said package having a wrapper which defines the outer dimensions of said package, said receptacle having a front, a back, a first end and a second end, a top and a bottom, and comprising:

a bottom wall, a first vertical tubular container comprising a first wall at said first end extending from said front to said back, said first wall being generally C-shaped in cross section, connected to said bottom wall, having a top and having a first diameter, a second vertical tubular container comprising a second wall at said second end extending from said front to said back, said second wall being generally C-shaped in cross section and connected to said bottom wall, having a top and having a second diameter, a first vertical connector wall at said front of said receptacle between said first and second walls, attached to said bottom wall and to said first and second walls from said bottom wall to said tops of said first and second walls separating and spacing them apart at said front of said receptacle and following in cross section a curvilinear path, said first vertical connector wall having a top, a second vertical connector wall at said back of said receptacle between said first and second walls opposite said first vertical connector wall and attached to said bottom wall separating and spacing said first and second walls apart, said second vertical connector wall having a top, said first vertical tubular container being in open communication with said second vertical tubular container from said bottom wall to the tops of said first vertical tubular container and said second vertical tubular container, said package passing through the communication between said first vertical tubular container and said second vertical tubular container, each top of said first wall, said second wall, said first vertical connector wall, and said second vertical connector wall having that wall's substantial cross section, said first and second diameters being approximately the same value and in close approximation to the average diameter of said rolls sufficient for close fit, removable storage of said package within said receptacle, said first vertical connector wall and said second vertical connector wall having a cross sectional width between them that is smaller than said average diameter of said toilet paper rolls.

2. The receptacle of claim 1, further comprising:

said cross sectional width of said first vertical connector wall and said second vertical connector wall being in close approximation to the outer dimensional width of said package between said rolls.

* * * * *